US007896676B2

(12) United States Patent
Ziberna

(10) Patent No.: US 7,896,676 B2
(45) Date of Patent: Mar. 1, 2011

(54) RETRACTABLE CONNECTOR FOR AN ELECTRONIC DEVICE

(75) Inventor: Frank J. Ziberna, Winfield, IL (US)

(73) Assignee: Bi-Link, Bloomingdale, IL (US)

( * ) Notice: Subject to any disclaimer, the term of this patent is extended or adjusted under 35 U.S.C. 154(b) by 0 days.

(21) Appl. No.: 12/388,408

(22) Filed: Feb. 18, 2009

(65) Prior Publication Data

US 2010/0015825 A1 Jan. 21, 2010

Related U.S. Application Data

(60) Provisional application No. 61/082,084, filed on Jul. 18, 2008.

(51) Int. Cl.
*H01R 13/62* (2006.01)

(52) U.S. Cl. ..... 439/310

(58) Field of Classification Search ..... 439/310; 369/75.2, 54, 270; 15/105–106, 118
See application file for complete search history.

(56) References Cited

U.S. PATENT DOCUMENTS

| | | | | |
|---|---|---|---|---|
| 4,271,354 | A * | 6/1981 | Shellenberger | 250/214 PR |
| 5,400,121 | A * | 3/1995 | Foote | 399/116 |
| 5,906,022 | A * | 5/1999 | Ohkawa et al. | 15/105 |
| 5,914,929 | A * | 6/1999 | Kato et al. | 720/656 |
| 6,817,879 | B2 * | 11/2004 | Mulvenna et al. | 439/310 |
| 7,062,816 | B2 * | 6/2006 | Kasper et al. | 15/340.2 |
| 2002/0174507 | A1 * | 11/2002 | Kasper et al. | 15/320 |

* cited by examiner

*Primary Examiner* — Jean F Duverne
(74) *Attorney, Agent, or Firm* — Erickson Law Group, PC

(57) ABSTRACT

A retractable connector device having an inner housing, a cover belt, and two sidewalls. The device may comprise electronic components for electronic devices including computer peripheral devices such as serial bus devices, Universal Serial Bus (USB) devices, or IEEE 1394 devices. The belt surrounds a portion of the inner housing. The belt is for moving the device between at least two positions, a deployed position where the connector extends through a hole in the inner housing to connect to a receiving device, and a stored position where the connector is within the housing, separated and protected from external elements by, at least in part, the belt.

20 Claims, 4 Drawing Sheets

RETRACTABLE CONNECTOR FOR AN ELECTRONIC DEVICE

This application claims the benefit of U.S. Provisional Ser. No. 61/082,084, filed on Jul. 18, 2008.

TECHNICAL FIELD OF THE INVENTION

The invention relates to the field of connectors for electronic devices, specifically connectors that are retractable when not in use.

BACKGROUND OF THE INVENTION

Many electronic devices have connectors for connecting to another device or receiver. Serial bus devices, Universal Serial Bus (USB) devices, or IEEE 1394 devices all connect to computers or other electronic devices with a connector. Many such devices are portable. These devices may be exposed to various elements and forces that may damage the connector, when for example, a user transports the device. Many connector devices have a removable cap for protecting the connector when not in use. However, the cap is easily misplaced.

The present inventor recognizes that it would be desirable to provide a connector housing for electronic devices, such as USB devices, that would protect the connector when the connector is not engaged with a receiving device. The present inventor recognizes a need for a device that is easily used by persons with dexterity difficulty. The present inventor recognizes a need for a means of protecting a connector that is a unified component of the device even when the connector is engaged with a receiving device.

SUMMARY OF THE INVENTION

The invention provides a retractable connector device having a connector and a housing for protecting the connector. The housing comprises an inner housing, a belt, and two sidewalls. The device has at least two positions, a deployed position where the connector is in position to connect to a receiver and/or receiving device, and a stored position where the connector is separated and protected from external elements by the belt. A user moves the device between the deployed and stored positions by moving the belt. A user may move the belt using a thumb plate attached to the belt.

When the device is in a stored position the belt covers a hole in the front of the inner housing. When the device is in a deployed position, the belt is clear of the hole and the connector passes through the hole to extend beyond the housing and is in a position to connect to a receiving device.

In operation, to move from stored position, a user will move the thumb plate toward the rear of the device to move the device toward the deployed position. In doing so, the belt is raised up the front face to clear the hole and the belt moves along the top surface of the inner housing. The belt wraps around the back end of the inner housing and continues on the bottom of the device toward the front of the device on a first bottom portion of the inner housing. The belt travels in a gap on the bottom of the inner housing between the first bottom portion and a second bottom portion. The gap is where the belt enters a cutout area of the inner housing and attaches to a connector mount of the connector.

When moving to the stored position from the deployed position, if the belt front edge is on the top portion of the inner housing it will move toward the front of the housing. The belt front edge will curve around the inner housing front upper surface, continuing down the front face to cover the hole and protect the connector.

The device may comprise electronic components for electronic devices including computer peripheral devices such as serial bus devices, Universal Serial Bus (USB) devices, or IEEE 1394 devices. A connector front surface of the connector may comprise any connector appropriate for a particular type of electronic device comprising a particular embodiment of the device. The device may comprise a storage device such as a hard disk drive (HDD), a solid-state drive (SSD), a flash drive, or a flash media card receiver. The device 100 may be used in any application where it would be desirable to cover or protect a signal connector when the connector is not connected to a receiving component or device.

Numerous other advantages and features of the present invention will become readily apparent from the following detailed description of the invention and the embodiments thereof, from the claims, and from the accompanying drawings.

DETAILED DESCRIPTION OF THE PREFERRED EMBODIMENTS

Figure 1:
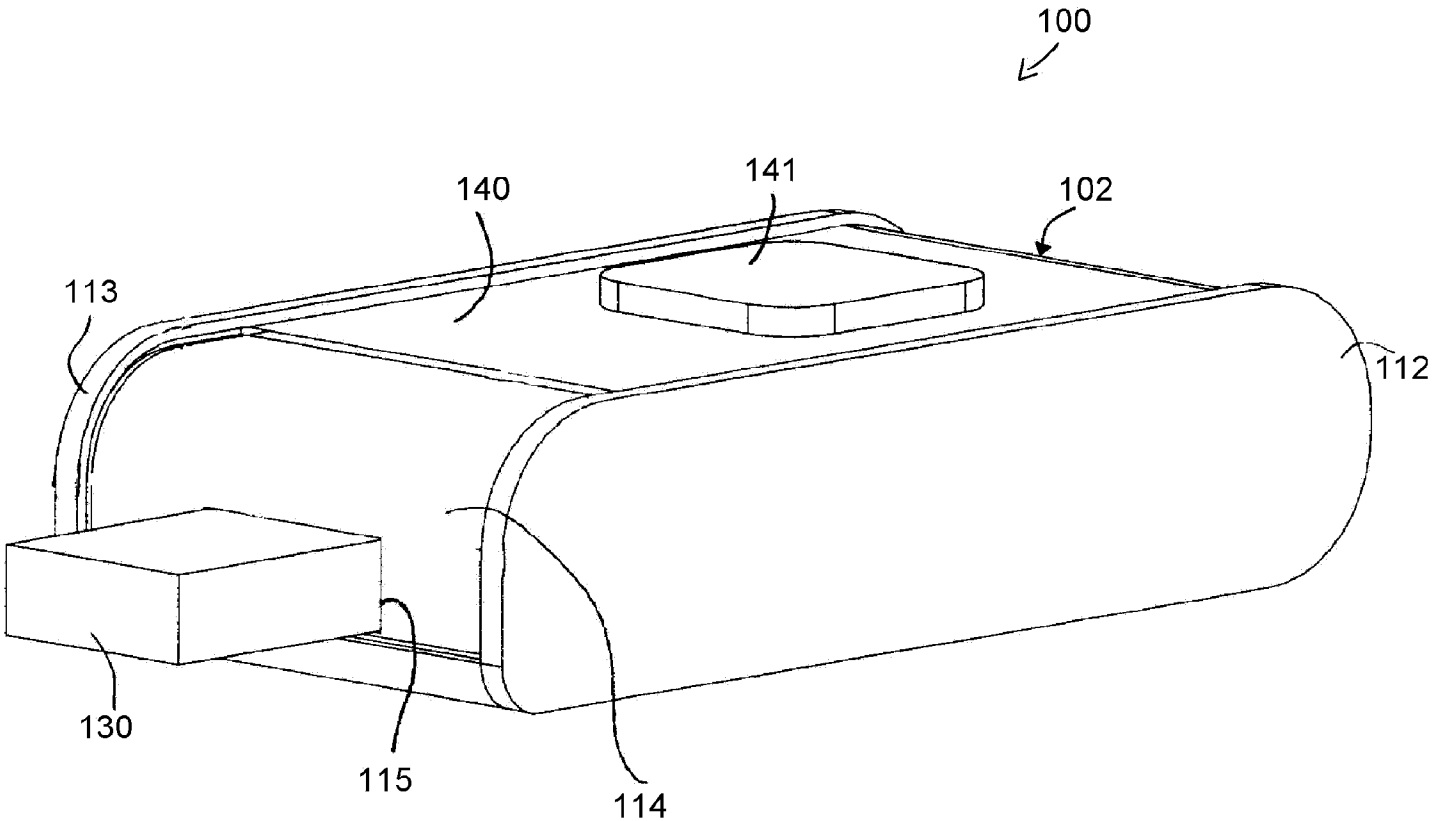
FIG. 1 is a right side perspective view of the retractable connector device of the present invention in a deployed position.

While this invention is susceptible of embodiment in many different forms, there are shown in the drawings, and will be described herein in detail, specific embodiments thereof with the understanding that the present disclosure is to be considered as an exemplification of the principles of the invention and is not intended to limit the invention to the specific embodiments illustrated.

The Overall System

FIG. 1 shows a retractable connector device 100 comprising a housing 120. The housing comprises a right sidewall 112, a left sidewall 113, and an inner housing 114. The connector device 100 also comprises a connector 130 and a cover belt 140 with a thumb plate 141.

Figure 2:
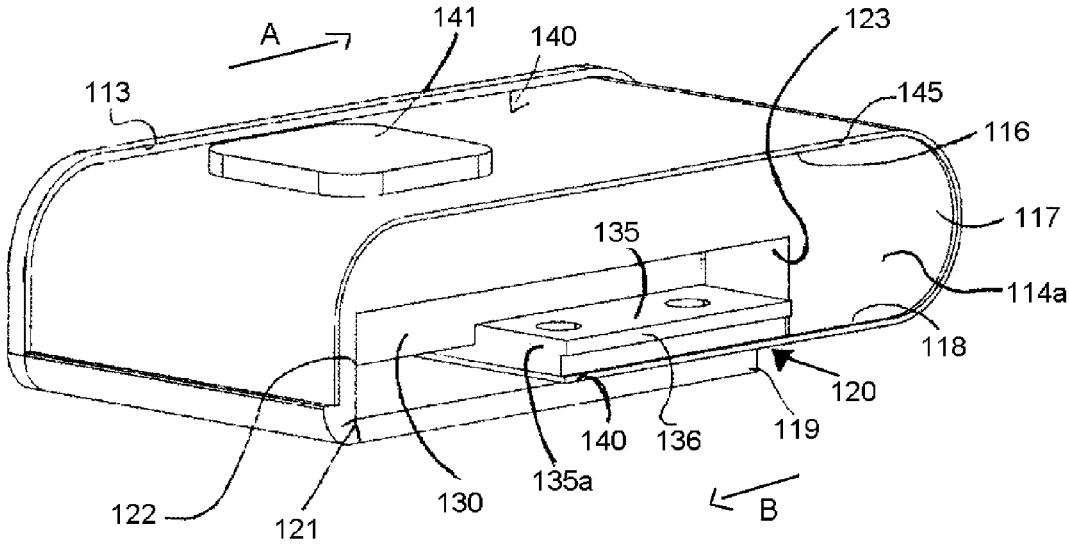
FIG. 2 is a right side perspective view of the retractable connector device in a stored position with the right sidewall removed.

The connector device 100 has an deployed position as shown in FIG. 1 where the connector 130 extends through a hole 115 in the front of the inner housing 114. The connector device 100 also has a stored position, as shown in FIG. 2, where the connector is retracted within the device 100. The connector 130 has an extended position corresponding to the deployed position of the device 100, and the connector 130 has a retracted position corresponding to the stored position of the device. In operation, movement of the belt 140 will cause the connector 130 to move between the retracted position (FIG. 2) where the connector is separated and protected from external elements by the belt, and the extended position (FIG. 1) where the connector is in position to connect to a receiver or a receiving device.

Belt

The belt 140 is connected to the connector 130 by a connector mount 135 near a bottom portion of the inner housing. The belt may comprise flexible plastic, rubber, or composite material. The thumb plate 141 is connected to the belt 140 on a top side of the housing when the device is in a stored position. The belt is flexible and is guided to travel along a partially curved track during operation. In operation, a user will move the thumb plate in the A direction as shown in FIG. 2 to cause the device 100 to move toward the deployed position. This will cause the belt 140 on the top portion 116 of the inner housing 114 to move in the A direction. The belt 140 will wrap around the back end 117 of the inner housing 114 and continue in the B direction on the first bottom portion 118 of the inner housing 114. The belt travels in a gap 120 on the bottom of the inner housing 114 between the first bottom portion 118 and the second bottom portion 119. The belt 140 travels on the bottom side of the first bottom portion 118 and the belt 140 travels on the top side of the second bottom portion 119.

Inner Housing

Figure 4:
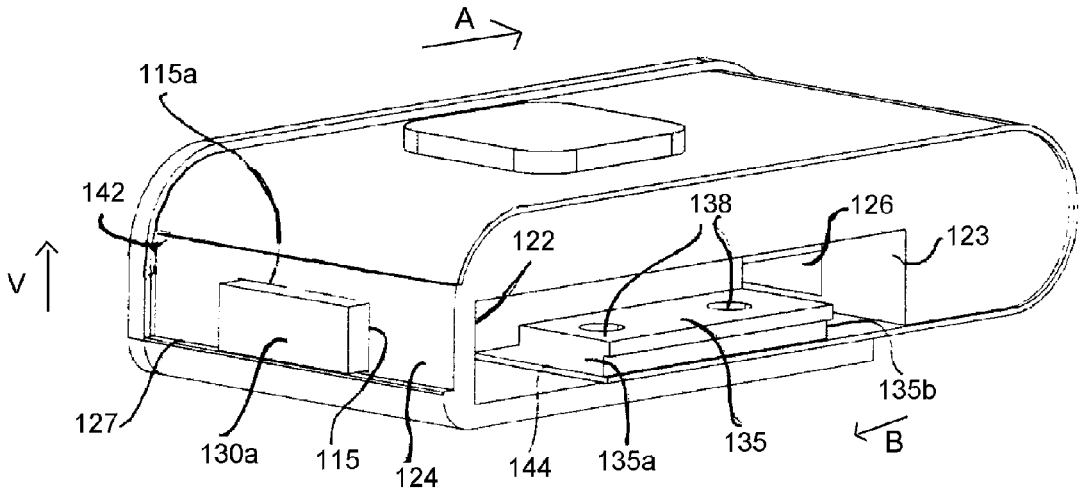
FIG. 4 is a right side perspective view of the retractable connector device with the right sidewall removed and showing the device in a position between a fully stored position and a fully deployed position.

The inner housing 114 comprises a cutout area 121 (FIG. 2). The cutout area 121 has a front wall 122 and a back wall 123. Referring to FIG. 4, as the belt 140 moves the connector 130 from the retracted position (FIG. 2) to the extended position (FIG. 1), the belt moves up the front face 124 of the inner housing 114. This causes the belt front edge 142 to raise in the V direction with the belt 114 and curve around the inner housing front upper surface 125 (FIG. 5), continuing in the A direction. The belt travel continues until the connector mount front surface 135*a*, traveling in the B direction, meets the front wall 122 of the inner housing 114 as shown in FIG. 5.

When moving the connector to the retracted position from the extended position, if the belt front edge 142 is on the top portion 116 it will move in the direction opposite the A direction. The belt front edge 142 will curve around the inner housing front upper surface 125 (FIG. 5), continuing down the front face 124 in the direction opposite of the V direction to cover the hole 115. In one embodiment, the belt front edge will continue in the direction opposite of the V direction until the belt front edge 142 meets the inner housing front lip 127. The belt 140 rides on a belt riding surface of the inner housing 141. The belt riding surface extends from the inner housing front lip 127 up the front face 124, across the top portion 116, around the end portion of the inner housing opposite the front face 124, and along a bottom portion of the inner housing before the gap 120 and closer to the end portion opposite the front face 124.

Figure 5:
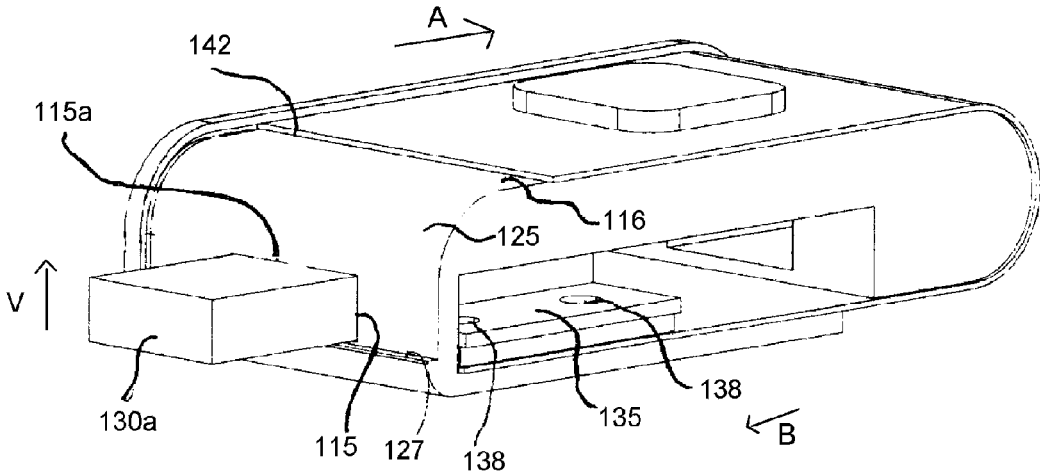
FIG. 5 is a right side perspective view of the retractable connector device with the right sidewall removed and showing the device in a fully deployed position.

When the connector mount front surface 135*a* meets the front wall 122 the connector 135 is in a fully extended position, as shown in FIG. 5. In the fully extended position, the belt front edge 142 is on the top portion 116 of the inner housing 114. However, in another embodiment, the belt front edge 142 may be at any position clear of the hole 115. In the fully retracted position, the connector mount rear surface meets the rear wall 123.

In another embodiment, the connector mount 135 need not meet the back wall 123 in a retracted position, nor the front wall 122 in an extended position. In this type of embodiment, the connector mount 135 may be at any position within the cutout area 121, between the front wall 122 and the back wall 123, when in a retracted position as long as a connector front surface 130*a* is behind the plane defined by the front face 124 of the inner housing 114. When moving from a extended position to a retracted position, the belt will travel properly on the inner housing 114 as long as the connector front surface 130*a* is behind the plane defined by the front face 124 before the belt front edge 142 meets the top edge 115*a* of the hole 115 when the belt is moving opposite the V direction (FIG. 4).

In another embodiment, the connector mount 135 need not meet the front wall 122 in an extended position. In this embodiment, connector mount 135 may be at any position within the cutout area 121, between the front wall 122 and the back wall 123, when in an extended position as long as the connector 130 extends beyond the plane defined by the front face 124 a sufficient length for the connector to engage a receiver or a receiving device. Also in this embodiment, the front connector front surface 130*a* must not break the plane defined by front face 124 before the belt front edge 142 clears the top edge 115*a* of the hole 115.

Side Walls

Figure 7:
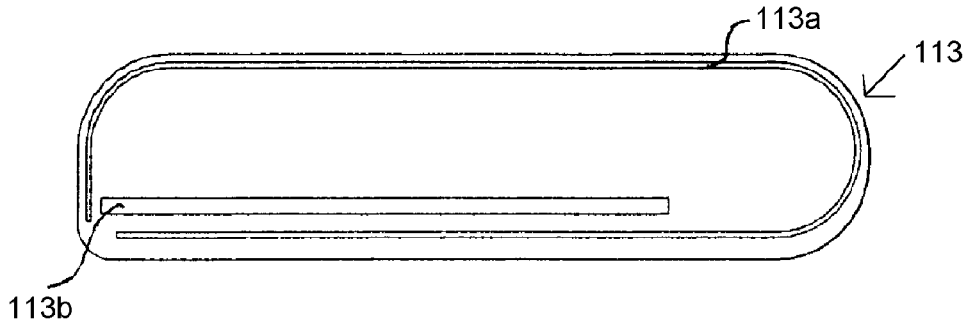
FIG. 7 is a left sidewall of the retractable connector device.

The left sidewall 113 connects to the inner housing left side 114*b* (FIG. 3) and the right sidewall 112 connects to the inner housing right side 114*a* (FIG. 2). The sidewalls 112, 113 are configured in mirror image fashion. FIG. 7 shows the left sidewall 113 comprising a belt groove 113*a* around at least a portion of the sidewall perimeter. The sidewall 113 also comprises a connector mount groove 113*b* extending horizontally along a lower portion of the sidewall. In another embodiment, the belt groove and the connector mount groove may be located on any portion of the sidewall that allows the connector 130 and the belt 140 to travel so that the device 100 functions to provide the connector 130 in an extended position and a retracted position.

In one embodiment, the left sidewall 113 may mount flush against the inner housing left side 114*b* and the right sidewall 112 may mount flush against the inner housing right side 114*a*. In this embodiment, the belt right edge 145 (FIG. 2) may extend beyond the vertical plane defined by the inner housing right side 114*a*, and the belt left edge 143 (FIG. 3) may extend beyond the vertical plane defined by the inner housing left side 114*b*. Therefore, the belt right edge 145 will extend into the belt groove (not shown) of the right sidewall 112, and belt left edge 143 will extend into the belt groove 113*a* (FIG. 7) of the right sidewall 113. The belt 140 travels within the belt grooves 113*a* of the sidewalls.

Figure 3:
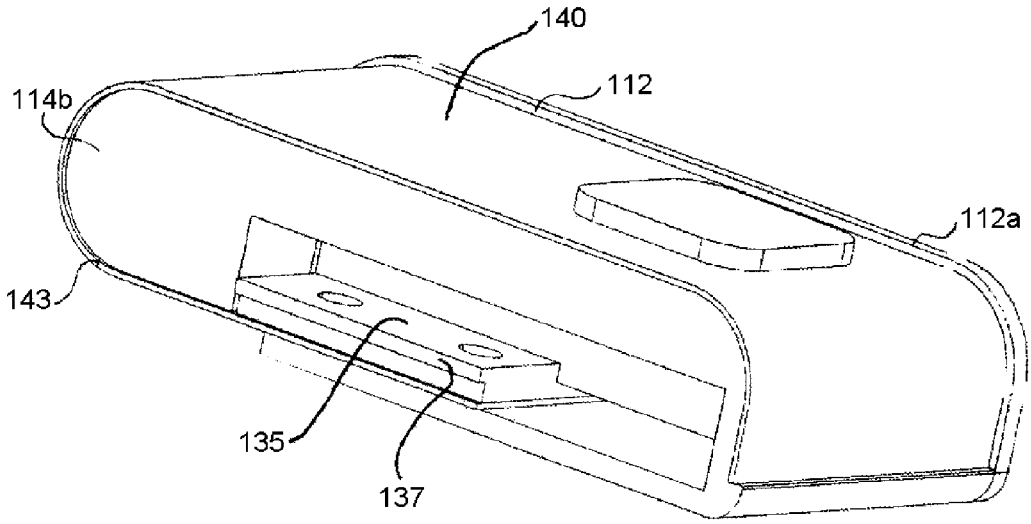
FIG. 3 is a left side perspective view of the retractable connector device in a stored position with the left sidewall removed.

In one embodiment, the top surface of the belt 140 may be recessed from the sidewall top surface 112*a* (FIG. 3). In another embodiment, the top surface of the belt may be flush with the top surface of the sidewall.

Connector

The connector 130 comprises the connector mount 135. The connector 130 and the connector mount 135 may be made from one piece of material or may be separate components connected with a fastener (not shown).

The device 100 and specifically the connector 130 may comprise electronic components for electronic devices including computer peripheral devices such as serial bus devices, Universal Serial Bus (USB) devices, or IEEE 1394 devices. The connector front surface 130*a* may comprise a USB connector or an IEEE 1394 connector. The connector front surface may comprise any connector appropriate for a particular type of electronic device comprising a particular embodiment of the device 100. The device 100 may comprise a storage device such as a hard disk drive (HDD), a solid-state drive (SSD), a flash drive, or a flash media card receiver. A cord (not shown) may extend from the device 100 for connecting to other components. The device 100 may be used in any application where it would be desirable to cover or protect a signal connector when the connector is not connected to a receiving component or device.

The connector mount 135 comprises mount ridges 136, 137 (FIGS. 2 and 3). In one embodiment, the right mount ridge 136 (FIG. 2) may extend beyond the plane defined by inner housing right side 114*a*, and the left mount ridge 137 (FIG. 3) may extend beyond the plane defined by the inner housing left side 114*b*. Therefore, the right mount ridge 136 will extend into the connector mount groove (not shown) of the right sidewall 112, and left mount ridge 137 will extend into the connector mount groove 113*b* (FIG. 7) of the right sidewall 113. The connector mount 135 travels within the connector mount grooves of the sidewalls 113, 112.

A portion of the belt 140 near the back edge 144 is connected to the connector mount 135. In one embodiment the connector mount 135 may be attached to the belt 140 with screws, bolts, or rivets 138 (FIGS. 4 and 5). In one embodiment, the connector mount 135 may be connected to the belt so that the connector mount front surface 135*a* is within the same plane as the back end/edge 144 of the belt 140. In another embodiment the connector mount front surface 135*a* need not be within the same plane as the back end/edge 144 of the belt 140.

Figure 6:
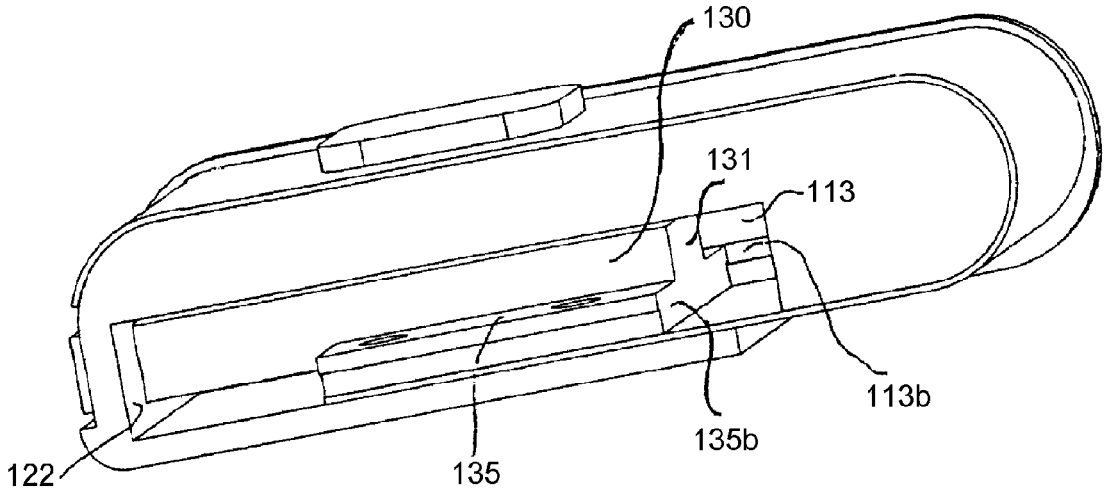
FIG. 6 is a right side perspective view of the retractable connector device with the right sidewall removed and showing the device in a position between a fully stored position and a fully deployed position.

FIG. 6 shows that the connector mount rear surface 135*b* is flush with the connector rear surface 131. In another embodiment, the connector rear surface 131 may extend beyond the plane defined by the connector mount rear surface 135*b*. FIG. 4 shows a rear hole 126 in the back wall 123 of the cutout area 121. If the connector rear surface 131 extends beyond the plane defined by the connector mount rear surface 135*b*, then the rear hole 126 can receive a portion of the connector 130 that extends beyond the plane defined by the connector mount rear surface 135*b*.

From the foregoing, it will be observed that numerous variations and modifications may be effected without departing from the spirit and scope of the invention. It is to be understood that no limitation with respect to the specific apparatus illustrated herein is intended or should be inferred.

I claim:

1. A retractable connector, comprising:

a housing, a connector configured to operatively connect an internal electronic component to an external device;

the connector operatively connected to a belt, the connector is movable between a retracted position and an extended position by the belt; the connector disposed within the housing when in a retracted position; the connector is configured to move along a connector travel path through an opening in the housing when moving between the retracted position and the extended position;

the belt configured to cover the opening when the connector is in the retracted position.

2. The retractable connector device of claim 1, wherein the belt at least partially encloses the connector within the inner housing when the connector is in the retracted position.

3. The retractable connector device of claim 1, wherein the belt comprises a user-operable thumb plate connected to the belt for moving the belt.

4. The retractable connector device of claim 1, wherein the opening allows the passing of a connecting-end portion of the connector from a position within the inner housing when the connector is in the retracted position to a position beyond the inner housing when the connector is in the extended position.

5. The retractable connector device of claim 4, wherein the belt is clear of the opening when the connector is in the extended position.

6. The retractable connector device of claim 1, wherein. the housing comprises a gap through which a portion of the belt passes from an exterior position on the housing to an interior position within the housing.

7. The retractable connector device of claim 1, wherein the housing comprises a cutout area for containing at least a portion of the connector.

8. The retractable connector device of claim 1, wherein the housing has a rear hole for receiving a rear portion of the connector when the connector is in the retracted position.

9. The retractable connector device of claim 1, comprising two sidewalk, each sidewall comprises a belt groove around at least a portion of the sidewall perimeter, side edge portions of the belt extend into each belt groove and are guided within each belt groove.

10. The retractable connector device of claim 9, wherein each sidewall comprises connector mount grooves extending along a portion of the side-wall; and wherein the connector rides on a carrier having two mount ridges; the mount ridges travel within the mount grooves to guide the connector.

11. The retractable connector device of claim 1, wherein the housing has a belt riding surface on which the belt travels, the belt riding surface extends along more, than one side of the housing, the transition between one side of the housing and the next side of the housing along the belt riding surface is curved.

12. The retractable connector device of claim 1, comprising one or more internal electronic components connected to the connector; the electronic components are contained within the housing when the connector is in the retracted position.

13. The retractable connector device of claim 1, wherein the belt covers at least a portion of three sides of the housing when the connector is in the retracted position.

14. The retractable connector device of claim 1, wherein the belt has a belt travel path, the belt travel path comprises a covering portion, the cover portion comprising the portion of the belt travel path where the belt covers the opening, the portion of the belt positioned along the cover portion of the belt travel path is substantially perpendicular to the connector travel path.

15. The retractable connector device of claim 1, wherein the belt has a belt travel path; the belt travel path comprises a covering portion, the cover portion comprises the portion of the belt travel path where the belt covers the opening, the cover portion of the travel path is perpendicular to the opening.

16. A retractable connector device comprising:

an inner housing for containing a connector, the housing having a hole;

the connector for connecting to an external receiver;

the connector having a retracted position and an extended position;

a first means for moving the connector between the retracted position and the retracted position;

the first means also for covering the hole through which the connector passes when moving from the retracted position to the extended position.

17. The retractable connector device of claim 16, wherein the first means surrounds a portion of the inner housing.

18. The retractable connector device of claim 16, wherein the first means surrounds a portion of the inner housing, and wherein the inner housing comprises a gap through which the first means passes to an interior position within the housing to connect to the connector.

19. An electronics carrier:

a housing;

a connector for operatively connect an internal electronic component to an external device;

the connector having a retracted position and an extended position, the connector disposed within the housing when in a retracted position; and a belt operably connected to the connector for moving the connector between the retracted position and the extended position the housing having an opening for passing a connecting-end portion of the connector from a position within the housing when the connector is in the retracted position to a position outside the housing when the connector is in the extended position.

20. An electronics carrier of claim 19, wherein the belt covers the opening when the connector is in the retracted position, and wherein the belt is clear of the opening when the connector is in the extended position.

* * * * *